US006113758A

United States Patent [19]

de Nora et al.

[11] Patent Number: 6,113,758

[45] Date of Patent: Sep. 5, 2000

[54] POROUS NON-CARBON METAL-BASED ANODES FOR ALUMINIUM PRODUCTION CELLS

[75] Inventors: Vittorio de Nora, Nassau, Bahamas; Jean-Jacques Duruz, Geneva, Switzerland

[73] Assignee: Moltech Invent S.A., Luxembourg

[21] Appl. No.: 09/126,840

[22] Filed: Jul. 30, 1998

[51] Int. Cl.[7] ..... C25B 11/00

[52] U.S. Cl. ..... 204/284; 204/290 R; 205/372; 205/374; 205/384

[58] Field of Search ..... 205/372, 374, 205/384; 204/290 R, 284

[56] References Cited

U.S. PATENT DOCUMENTS 5,510,008 4/1996 Sekhar et al. ..... 205/384

5,651,874 7/1997 de Nora et al. ..... 205/372

5,720,860 2/1998 Sekhar et al. ..... 204/290 R

*Primary Examiner*—Bruce F. Bell

*Attorney, Agent, or Firm*—Jayadeep R. Deshmukh

[57] ABSTRACT

A non-carbon, metal-based anode (10) of a cell for the electrowinning of aluminium, comprising an electrically conductive, high temperature resistant and oxidation resistant metal structure (11) in the form of a wire mesh or net, a foraminate sheet, a fibrous network, a reticulated skeletal structure, or a porous structure having voids, recesses and/or pores which are filled or partly filled with an electrochemically active filling (12), such as oxides, oxyfluorides, phosphides, carbides, cobaltites and cuprates making the surface of the anode (10) conductive and electrochemically active for the oxidation of oxygen ions present at the anode surface/electrolyte (5) interface.

58 Claims, 1 Drawing Sheet

POROUS NON-CARBON METAL-BASED ANODES FOR ALUMINIUM PRODUCTION CELLS

FIELD OF THE INVENTION

This invention relates to non-carbon metal-based anodes for use in cells for the electrowinning of aluminium by the electrolysis of alumina dissolved in a molten fluoride-containing electrolyte, and to methods for their production and reconditioning, as well as to electrowinning cells containing such anodes and their use to produce aluminium.

BACKGROUND ART

The technology for the production of aluminium by the electrolysis of alumina, dissolved in molten cryolite, at temperatures around 950° C. is more than one hundred years old.

This process, conceived almost simultaneously by Hall and Héroult, has not evolved as many other electrochemical processes.

The anodes are still made of carbonaceous material and must be replaced every few weeks. The operating temperature is still not less than 950° C. in order to have a sufficiently high solubility and rate of dissolution of alumina and high electrical conductivity of the bath.

The carbon anodes have a very short life because during electrolysis the oxygen which should evolve on the anode surface combines with the carbon to form polluting $CO_2$ and small amounts of CO and fluorine-containing dangerous gases. The actual consumption of the anode is as much as 450 Kg/Ton of aluminium produced which is more than ⅓ higher than the theoretical amount of 333 Kg/Ton.

The frequent substitution of the anodes in the cells is still a clumsy and unpleasant operation. This cannot be avoided or greatly improved due to the size and weight of the anode and the high temperature of operation.

Several improvements were made in order to increase the lifetime of the anodes of aluminium electrowinning cells, usually by improving their resistance to chemical attacks by the cell environment and air to those parts of the anodes which remain outside the bath. However, most attempts to increase the chemical resistance of anodes were coupled with a degradation of their electrical conductivity.

U.S. Pat. No. 4,614,569 (Duruz et al.) describes anodes for aluminium electrowinning coated with a protective coating of cerium oxyfluoride, formed in-situ in the cell or pre-applied, this coating being maintained by the addition of cerium to the molten cryolite electrolyte. This made it possible to have a protection of the surface only from the electrolyte attack and to a certain extent from the gaseous oxygen but not from the nascent monoatomic oxygen.

EP Patent application 0 306 100 (Nyguen/Lazouni/Doan) describes anodes composed of a chromium, nickel, cobalt and/or iron based substrate covered with an oxygen barrier layer and a ceramic coating of nickel, copper and/or manganese oxide which may be further covered with an in-situ formed protective cerium oxyfluoride layer.

Likewise, U.S. Pat. Nos. 5,069,771, 4,960,494 and 4,956,068 (all Nyguen/Lazouni/Doan) disclose aluminium production anodes with an oxidised copper-nickel surface on an alloy substrate with a protective barrier layer. However, full protection of the alloy substrate was difficult to achieve.

A significant improvement described in U.S. Pat. No. 5,510,008, and in International Application WO96/12833 (Sekhar/Liu/Duruz) involved micropyretically producing a body from nickel, aluminium, iron and copper and oxidising the surface before use or in-situ. By said micropyretic methods materials have been obtained whose surfaces, when oxidised, are active for the anodic reaction and whose metallic interior has low electrical resistivity to carry a current from high electrical resistant surface to the busbars. However it would be useful, if it were possible, to simplify the manufacturing process of these materials and increase their life to make their use economic.

U.S. Pat. No. 5,725,744 (de Nora/Duruz) describes aluminium electrowinning cells provided with an upward circulation of electrolyte by gas lift between the electrodes which can be porous or reticulated skeletal anode structures of coated metal having a high active surface area and allowing for internal electrolyte circulation and gas release.

Metal or metal-based anodes are highly desirable in aluminium electrowinning cells instead of carbon-based anodes. As described hereabove, many attempts were made to use metallic anodes for aluminium production, however they were never adopted by the aluminium industry because of their poor performance.

OBJECTS OF THE INVENTION

A major object of the invention is to provide an anode for the electrowinning of aluminium which has no carbon so as to eliminate carbon-generated pollution, which has a long life and which reduces the high cell operating costs.

A further of the invention is to provide an aluminium electrowinning anode material with a surface having a high electrochemical activity for the oxidation of oxygen ions and a low solubility in the electrolyte.

Another object of the invention is to provide an aluminium electrowinning anode structure which has a reduced electrical resistivity.

An important object of the invention is also to provide an aluminium electrowinning anode which has an electrochemically active surface operating at a low effective current density but which, over the anode area facing the cathode, is apparently high and an enhanced elimination of the gaseous oxygen formed thereon.

Yet another object of the invention is to provide an anode with an electrochemically active material which is thick enough to resist long-lasting wear while offering only a low electrical resistance.

An object of the invention is also to provide an aluminium electrowinning anode structure which may have different sections protected with different kinds of protective materials against specific attacks. These different sections may for instance be the section of the anode active surface facing a cathode; the inactive section immersed in the electrolyte carrying current to the active section; the section of the anode at the electrolyte surface interface; the section of the anode above the electrolyte surface surrounded by gas or frozen electrolyte; or the section of the anode outside the cell.

Yet a further object of the invention is to provide an aluminium electrowinning anode structure which can carry an increased amount of electrochemically active material, thereby increasing the lifetime of the anode.

It is also an object of the invention to provide an aluminium electrowinning anode which can be maintained dimensionally stable by adequate operation of the cell.

SUMMARY OF THE INVENTION

The invention relates to a non-carbon, metal-based anode of a cell for the electrowinning of aluminium, in particular by the electrolysis of alumina dissolved in a molten fluoride-based electrolyte. The anode comprises an electrically conductive, high temperature resistant and oxidation resistant metal structure in the form of a wire mesh or net, a foraminate sheet such as an expanded mesh or a perforated sheet, a fibrous network, a reticulated skeletal structure such as a foam or a honeycomb, or a porous structure, all having voids, recesses and/or pores which are at least partly filled with an electrically conductive and electrochemically active material to form an anode for the oxidation of oxygen ions present at the anode surface/electrolyte interface.

In contrast to conventional aluminium electrowinning anodes, the surfaces forming the voids, recesses and/or pores at the electrochemical active anode surface area of the metal structure offer a great effective surface through which the current passes to a facing cathode, thereby providing for a lower current density on the surfaces forming the voids, recesses and/or pores, while offering the same active anode area facing the cathode. Thus, this invention permits an increase in the current passing from the anode to a facing cathode without increasing the anode size.

Additionally, by filling voids, recesses and/or pores with electrochemically active material, the amount of active material is much greater than that of the surface of a conventional anode, leading to a longer anode life. Moreover, the amount of electrochemically active material present in the voids, recesses and/or pores of the structure has only little effect on the overall conductivity of the anode since the metal structure offers a highly conductive connection from a current supply to the anode/electrolyte interface, even when the structure is thoroughly filled with active material.

Furthermore, different sections of the metal structure exposed to different cell conditions may be filled with different types of materials, each type of material being adapted to resist the specific conditions to which the anode may be locally exposed.

The active anode surface should be filled with an electrochemically active and sufficiently electrically conductive material which is well resistant to the electrolyte and to ionic, monoatomic and biatomic gaseous oxygen as will be described later.

The remaining immersed anode surfaces should be resistant to the electrolyte and to anodically produced gases, however these surfaces do not need to be electrochemically active and can be inert. The same materials may be used as for the active anode surface or inert materials such as silicon nitride, aluminium nitride, boron nitride, magnesium ferrite, magnesium aluminate, magnesium chromite, zinc oxide, nickel oxide or a nickel-copper alloy, in particular a nickel-rich alloy.

The parts of the anode which are above the surface of the electrolyte should be resistant to gaseous attacks and if present to the electrolyte crust. Protective materials fulfilling this criteria are copper, copper oxide or a copper-nickel alloy, in particular a copper-rich alloy.

The areas of the anode which are close to the surface of the electrolyte should combine the protective properties of the immersed surfaces and of the parts above the surface, since the level of electrolyte may vary during operation of the cell. Parts of the electrode outside the cell should be as conductive as possible and the filling can be made predominantly of copper.

Preferably, the metal structure comprises at least two zones or sections filled or partly filled with different materials. For example the anode may comprise different materials filling the voids, recesses and/or pores located below the surface of the electrolyte and the voids, recesses and/or pores located above the surface of the electrolyte. Below the surface of the electrolyte, the filling material should be well resistant to the electrolyte, whereas above the electrolyte less resistant but more conductive materials may be used.

Advantageously, the voids, recesses and/or pores located below the surface of the electrolyte are filled with electrochemically active material where during operation in the cell the reaction of oxidation of oxygen ions into monoatomic oxygen and subsequent formation of biatomic gaseous oxygen takes place, whereas those voids, recesses and/or pores below the surface of the electrolyte may be filled with conductive but inert materials.

The portion of the anode above the surface of the electrolyte may also be divided into two parts. One part, just above the electrolyte has its voids, recesses and/or pores filled with material which is resistant to the corrosive or oxidising gases escaping from the electrolyte. Another part, outside the cell or otherwise not exposed to an oxidising or corrosive media, has its voids, recesses and/or pores filled with highly conductive material.

The anode of the invention may be of any suitable shape which can be obtained from a metal structure designed to contain a desired amount of electrochemically active material.

Possibly some of the voids, recesses and/or pores may be only partly filled with the electrochemically active material leaving an unfilled cavity in said partly filled voids, recesses and/or pores. For instance, some voids, recesses and/or pores may have their surfaces coated with a layer of the electrochemically active material. Alternatively, in some embodiments the voids, recesses and/or pores may be substantially filled with the electrochemically active material, for instance more than 50 vol % of the voids, recesses and/or pores may be filled with the material.

In addition, the electrochemically active material may also be porous.

Advantageously, the surface of the metal structure may be inert and substantially resistant to the electrolyte and the product of electrolysis.

The metal structure can comprise at least one metal selected from nickel, cobalt, chromium, copper, molybdenum and tantalum, and their alloys or intermetallic compounds, and combinations thereof. For instance the metal structure may be nickel-plated copper or a nickel copper alloy.

Advantageously, the metal structure may be covered with an oxygen barrier layer. The oxygen barrier may be formed on the metal structure by applying a slurry, for example by brushing, or by electrodeposition, and heat treating. Alternatively, the oxygen barrier may be formed on the metal structure by oxidising the surface of the metal structure. Usually, the oxygen barrier layer comprises chromium oxide and/or black non-stoichiometric nickel oxide.

Such oxygen barrier can be covered with a protective layer that protects the oxygen barrier by inhibiting its dissolution, but which during electrolysis remains inactive in the reactions for the evolution of oxygen gas. The protective layer may be applied by electrodeposition. Usually, the protective layer comprises copper, or copper and at least one of nickel and cobalt, and/or (an) oxide(s) thereof.

The electrochemically active material usually comprises constituents selected from oxides, oxyfluorides, phosphides, carbides, and combinations thereof, such as cerium oxyfluoride.

An oxide may be present in the electrochemically active material as such, or in a multi-compound mixed oxide and/or in a solid solution of oxides. The oxide may be in the form of a simple, double and/or multiple oxide, and/or in the form of a stoichiometric or non-stoichiometric oxide.

The electrochemically active material may in particular comprise spinels and/or perovskites, such as ferrites. The ferrites may be selected from cobalt, manganese, molybdenum, nickel, magnesium and zinc ferrite, and mixtures thereof, in particular nickel ferrite partially substituted with $Fe^{2+}$. Additionally, the ferrite may be doped with at least one oxide selected from chromium, titanium, tin and zirconium oxide.

Advantageously, the electrochemically active material can additionally comprise an electrocatalyst for the oxidation of oxygen ions present at the surface of the anode to form monoatomic nascent oxygen and subsequently biatomic molecular gaseous oxygen. The electrocatalyst may for instance be selected from iridium, palladium, platinum, rhodium, ruthenium, silicon, tin and zinc, the Lanthanide series and Mischmetal, and their oxides, mixtures and compounds thereof.

The electrochemically active material may comprise at least one metal selected from iron, chromium and nickel, and oxides, mixtures and compounds thereof. The metals may be pre-oxidised before immersion into the electrolyte or oxidising during use to form the electrochemically active material. As stated above, chromium oxide and black non-stoichiometric nickel oxide form a good barrier to oxygen and protect the metal substrate from oxygen attack.

The electrochemically active material may be obtained from a precursor, the constituents of which react among themselves to form the active material when subjected to heat-treatment. Alternatively or cumulatively, constituents may react with the metal structure to form the active material during heat treatment. Optionally, a substantially cryolite-resistant bonding material may bond the electrochemically active constituents of the filling together and within the voids, recesses and/or pores of the metal structure.

The electrochemically active material may be applied in the form of powder into the voids, recesses and/or pores of the metal substrate. Alternatively, the electrochemically active material may be applied as a slurry or suspension containing colloidal material which is a dried and/or heat treated. The colloid may be selected from colloidal alumina, ceria, lithia, magnesia, silica, thoria, yttria, zirconia and colloids containing active constituents of the active material.

The invention also relates to a method of manufacturing a non-carbon, metal-based anode of a cell as described above. The method comprises filling at least partly the voids, recesses and/or pores of the metal structure with an electrically conductive and electrochemically active material or a precursor thereof, and heat-treating the active material or precursor contained in the voids, recesses and/or pores to consolidate and form an anode for the oxidation of oxygen ions in electrolyte.

The method for manufacturing the anode may also be applied for reconditioning a used metal-based anode when at least part of the active material is worn or damaged. The method comprises clearing at least the worn or damaged parts of the material contained within the voids, recesses and/or pores of the porous, foam structure before at least partly refilling said voids, recesses and/or pores with an active material or precursor thereof, and heat treatment to reform the anode for the oxidation of oxygen ions in the electrolyte.

Another aspect of the invention is a cell for the electrowinning of aluminium equipped with at least one non-carbon metal-based anode as described above.

Advantageously, the cell may comprise at least one aluminium-wettable cathode which can be a drained cathode on which aluminium is produced and from which it continuously drains.

Usually, the cell is in a monopolar, multi-monopolar or in a bipolar configuration. Bipolar cells may comprise the anodes as described above as the anodic side of at least one bipolar electrode and/or as a terminal anode.

In such a bipolar cell an electric current is passed from the surface of the terminal cathode to the surface of the terminal anode as ionic current in the electrolyte and as electronic current through the bipolar electrodes, thereby electrolysing the alumina dissolved in the electrolyte to produce aluminium on each cathode surface and oxygen on each anode surface.

Preferably, the cell comprises means to improve the circulation of the electrolyte between the anodes and facing cathodes and/or means to facilitate dissolution of alumina in the electrolyte. Such means can for instance be provided by the geometry of the cell as described in co-pending application PCT/IB98/00161 (de Nora/Duruz) or by periodically moving the anodes as described in co-pending application PCT/IB98/00162 (Duruz/Bello).

The cell may be operated with the electrolyte at conventional temperatures, such as 950 to 970° C., or at reduced temperatures as low as 700° C.

Yet another aspect of the invention is a method of producing aluminium in such a cell, wherein oxygen ions in the electrolyte are oxidised and released as molecular oxygen by the electrochemically active anode material.

BRIEF DESCRIPTION OF THE DRAWINGS

The invention is further described with reference to the drawings in which.

DETAILED DESCRIPTION

Figure 1:
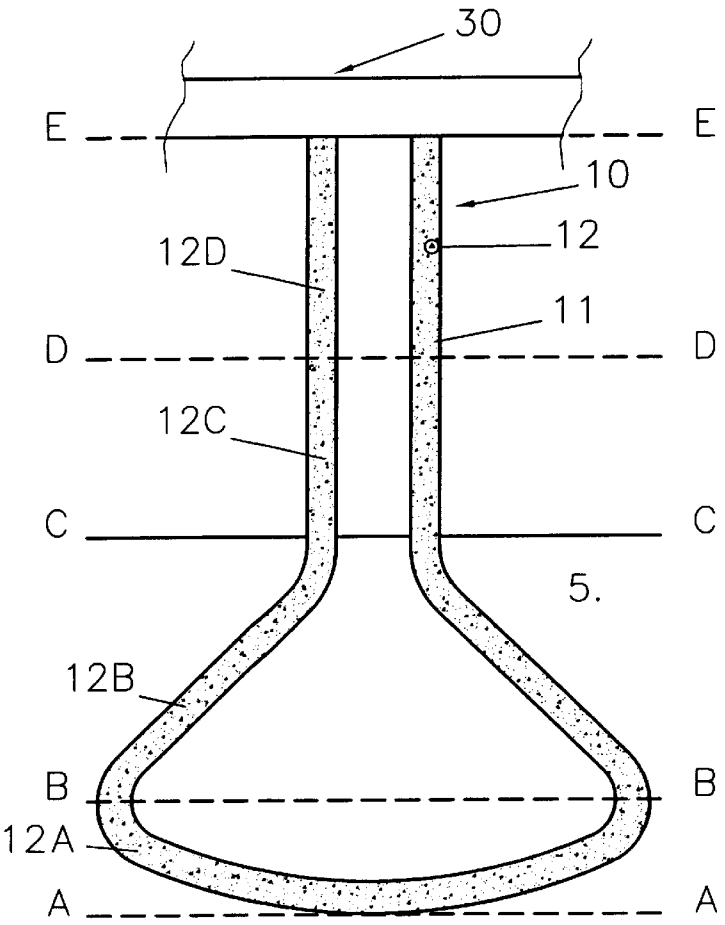
FIG. 1 is a schematic cross-section view of an anode according to the invention comprising a porous structure which is filled with different types of materials.

FIG. 1 shows an anode 10 which is made of a conductive porous metal foam sheet 11 which can for instance consist of a porous metallic nickel foam having a thickness of 10 to 20 mm. The voids, recesses and/or pores of the porous sheet 11 are filled or partly filled with different types of materials 12.

The porous sheet 11 filled with the materials 12 is bent along its cross-section into a bell-like shape as shown in FIG. 1 and both ends of the of the bent porous sheet 11 forming the upper part of the anode 10 are connected by any convenient means to a positive bus bar 30.

The anode 10 is immersed in a fluoride-containing molten electrolyte 5. The central part of the porous sheet 11 comprised between the dashed reference lines A and B constitutes the lower part of the anode 10 facing a cathode (not shown). The lower part of the anode 10 is slightly arched to favour the escape of anodically produced oxygen.

The voids, recesses and/or pores of the lower part of the anode 10 are filled or partly filled with a material 12A which is electrochemically active for the oxidation of oxygen ions to produce monoatomic and subsequently biatomic gaseous oxygen. The electrochemically active material 12A, such as nickel ferrite, may be applied into the voids, recesses and/or pores by dipping the lower part of the anode 10 in a precursor slurry and heat treating to convert the precursor to nickel ferrite.

The immersed parts of the anode 10 comprised between the dashed reference line B and the surface C of the electrolyte 5 contains a material 12B which makes it electrically conductive, resistant to the electrolyte but does not need to be electrochemically active and can be inert. The voids, recesses and/or pores of this part of the anode 10 may be filled or partly filled with nickel-rich nickel-copper alloy by electrodeposition. During electrolysis the material 12B such as nickel-copper alloy present in the voids, recesses and/or pores may passivate or substantially passivate by forming, on its surface which is in contact with the electrolyte 5, nickel oxide.

The parts of the anode 10 which are above the surface C of the electrolyte 5 and below the electrolyte crust or cell cover schematised by the dashed reference line D should be filled or partly filled with a material 12C making it resistant to the oxidising and/or corrosive gas escaping from the surface C of the electrolyte 5. The voids, recesses and/or pores of these parts of the anode 10 can be at least partly filled with copper-rich copper-nickel alloy by electrodeposition.

The parts of the anode above the dashed reference line D and below the reference line E forming the lower part of the positive bus bar 30 do not need to be particularly resistant to oxidation or corrosion. The voids, recesses and/or pores of these parts may be filled or partly filled with a conductive material 12D such as copper by electrodeposition.

Figure 2:
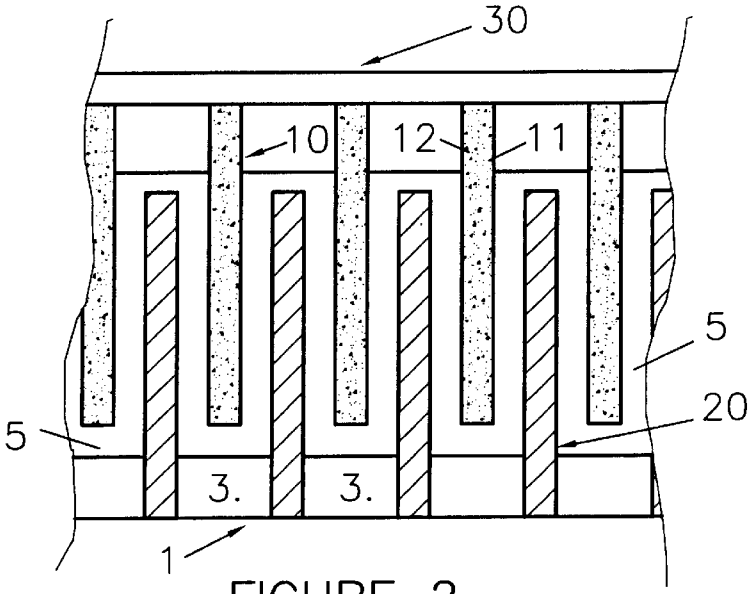
FIG. 2 is a schematic illustration of part of a multi-monopolar cell comprising a series of anodes according to the invention.

FIG. 2 shows a multimonopolar cell design with a series of vertical anodes 10 and cathodes 20 held apart in spaced parallel relationship. The cathodes 20 between the anodes 10 extend downwardly and dip in a pool of cathodic aluminium 3 on the cell bottom 1. The cell bottom 1 contains collector bars (not shown) for the supply of current to the cathodes 20.

The tops of the cathodes 20 are located below the the surface of a fluoride-containing electrolyte 5, such as cryolite-based.

The anodes 10 extend up above the tops of the cathodes 20 and the surface of the electrolyte 5, and are connected by suitable means to a positive bus bar 30. The level of the aluminium pool 3 may fluctuate but remains always below the bottoms of the anodes 10.

As for the anode 10 in FIG. 1, the anodes 10 consist of a conductive porous metal foam sheet 11 for instance metallic nickel foam having a thickness of 10 mm to 20 mm. The voids, recesses and/or pores of the porous sheet 11 are filled or partly filled at least with electrochemically active material for the anodic reaction but the anodes 10 may comprise different zones adapted to different environments by having their voids, recesses and/or pores filled with different kinds of material 12, as for the anode of FIG. 1.

Figure 3:
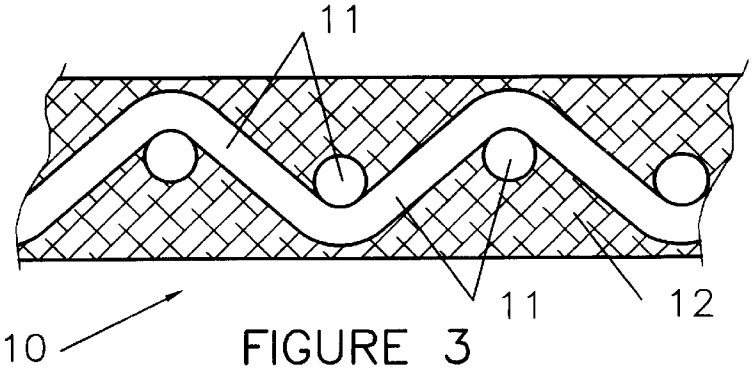
FIG. 3 is a schematic illustration of a wire net filled and covered with electrochemically active material forming part of an anode according to the invention.

FIG. 3 shows part of an anode 10 comprising a metal structure in the form of a wire net or mesh 11 filled with an electrochemically active material 12.

The wire net 11 conducts the current from a positive bus bar to the electrochemically active material 12. The wire net 11 may for instance be made of nickel or nickel-plated copper wires having a thickness of the order of 2 mm, optionally coated with chromium oxide and a protective layer of oxidised nickel and/or copper.

The electrochemically active material 12 is preferably applied by dipping the wire mesh 11 in a slurry, for instance a precursor slurry of nickel ferrite, and heat treated to convert and/or consolidate the precursor slurry into the electrochemically active material 12.

The portion of the anode 10 shown in FIG. 3 may be in the form of a plate or sheet as shown in FIG. 2 or bent as shown in FIG. 1 and filled with different materials 12 adapted to the local environment and requirements of the anode 10 during use.

The invention will be further described in the following Examples:

EXAMPLE 1

A test anode was made from a 5 mm thick commercially available nickel foam structure obtainable from a polymer foam having 10 to 30 ppi (4.8 to 14.5 pores/cm) prepared according to the teachings of U.S. Pat. No. 5,374,491 (Brannan et al) and U.S. Pat. No. 5,738,907 (Vaccaro et al).

A nickel-ferrite containing slurry was prepared by mixing an amount of 200 g of commercially available nickel ferrite powder with 150 ml of an inorganic polymer containing 0.25 g nickel-ferrite per 1 ml of water.

The foam structure was filled with nickel ferrite by dipping the structure into the nickel-ferrite containing slurry. The structure was dipped in this slurry and dried several times in order to substantially fill the foam. Finally the structure was heat-treated at 500° C. for 1 hour to decompose volatile components and to consolidate the oxide filling.

The anode was then tested in a molten fluoride-based electrolyte at 850° C. containing approximately 6 weight % alumina at a current density of about 0.8 $A/cm^2$ of the effective surface area of the anode and a low cell voltage of 3.8 to 4.2 V. After 100 hours the anode was extracted from the electrolyte and showed no sign of significant internal or external corrosion after microscopic examination of a cross-section of the anode specimen. Parts of the nickel foam which had been exposed to the electrolyte melt were passivated during electrolysis.

EXAMPLE 2

A test anode was made by electrodepositing a chromium layer on a nickel plated copper foam and oxidising the chromium layer at 1000° C. for 5 hours in air to form chromium oxide layer which is known to act as a barrier to oxygen.

The oxygen barrier was covered in turn with an electrodeposited copper-nickel alloy forming a protective layer preventing dissolution of the chromium oxide layer into the electrolyte during operation in a cell.

As in Example 1, the coated foam structure was then filled with electrochemical material and tested under similar conditions and showed similar results.

EXAMPLE 3

An anode was made from a 4 mm thick commercially available nickel wire mesh (16 $kg/M^2$) structure made of 2 mm diameter strands (2.5 strand/cm).

The wire mesh structure was heat treated in air at 1100° C. for 16 hours to pre-oxidise its surface.

A nickel-ferrite containing slurry was prepared by mixing an amount of 200 g of commercially available nickel-ferrite powder (particle size comprised between 1 and 10 micron and mean particle size of 2.5 micron) with 150 ml of an inorganic polymer containing 0.25 g nickel-ferrite precursor per 1 ml of water.

The pre-oxidised wire mesh structure was filled and coated with nickel-ferrite by dipping the structure into the nickel-ferrite containing slurry. The structure was dipped in the slurry and dried several times in order to substantially fill the voids of the wire mesh structure. Finally the wire mesh structure was heat treated with the dried nickel-ferrite slurry for 1 hour at 500° C. to decompose volatile components and consolidate the oxide filling to form the anode.

The anode was then tested in a molten fluoride-based electrolyte at 850° C. containing approximately 6 weight % alumina at a current density of about 0.8 A/cm$^2$ of of the effective surface area of the anode mesh and at a cell voltage of 3.6 to 3.8 V.

After 100 hours the anode was extracted from the electrolyte and showed no sign of significant internal or external corrosion under microscopic examination of a cross-section. Parts of the nickel wire mesh structure which had been exposed to the electrolyte were passivated during electrolysis.

What is claimed is:

1. A non-carbon, metal-based anode of a cell for the electrowinning of aluminium, comprising an electrically conductive, high temperature resistant and oxidation resistant metal structure in the form of a wire mesh or net, a foraminate sheet, a fibrous network, a reticulated skeletal structure, or a porous structure having voids, recesses and/or pores which are at least partly filled with an electrically conductive and electrochemically active material applied thereinto to form an anode for the oxidation of oxygen ions present at the anode surface/electrolyte interface.

2. The anode of claim 1, wherein at least some of the voids, recesses or pores are only partly filled with the electrochemically active material leaving an unfilled cavity in said partly filled voids, recesses or pores.

3. The anode of claim 1, wherein the electrochemically active material in said voids, recesses or pores is porous.

4. The anode of claim 1, wherein the surface of the metal structure, during electrolysis, is inert and substantially resistant to the electrolyte and the product of electrolysis.

5. The anode of claim 4, wherein the metal structure is covered with an oxygen barrier layer.

6. The anode of claim 5, wherein the oxygen barrier layer comprises chromium oxide and/or black non-stoichiometric nickel oxide.

7. The anode of claim 5, wherein the oxygen barrier layer is covered with a protective layer protecting the oxygen barrier by inhibiting its dissolution and which during electrolysis remains electrochemically inactive.

8. The anode of claim 7, wherein the protective layer comprises copper, or copper and at least one of nickel and cobalt, and/or oxide(s) thereof.

9. The anode of claim 1, wherein the metal structure comprises at least one metal selected from the group consisting of nickel, cobalt, chromium, copper, molybdenum and tantalum, and their alloys or intermetallic compounds, and combinations thereof.

10. The anode of claim 9, wherein the metal structure is nickel-plated copper or a nickel-copper alloy.

11. The anode of claim 1, wherein the electrochemically active material comprises constituents selected from the group consisting of oxides, oxyfluorides, phosphides, carbides, and combinations thereof.

12. The anode of claim 11, wherein the electrochemically active material comprises cerium oxyfluoride.

13. The anode of claim 11, wherein the electrochemically active material comprises spinels and/or perovskites.

14. The anode of claim 13, wherein the electrochemically active material comprises ferrites.

15. The anode of claim 14, wherein the electrochemically active material comprises at least one ferrite selected from the group consisting of cobalt, manganese, molybdenum, nickel, magnesium and zinc ferrite, and mixtures thereof.

16. The anode of claim 1, wherein the electrochemically active material comprises electrochemically active constituents and an electrocatalyst for the oxidation of oxygen ions present at the surface of the anode to form monoatomic nascent oxygen and subsequently biatomic molecular gaseous oxygen.

17. The anode of claim 16, wherein the electrocatalyst is selected from the group consisting of iridium, palladium, platinum, rhodium, ruthenium, silicon, tin and zinc, the Lanthanide series and Mischmetal, and their oxides, mixtures and compounds thereof.

18. The anode of claim 1, wherein the electrochemically active material comprises at least one metal selected from the group consisting of iron, chromium and nickel, and oxides, mixtures and compounds thereof.

19. The anode of claim 1, wherein the electrochemically active material comprises electrochemically active constituents and a substantially cryolite-resistant bonding material bonding the electrochemically active constituents of the filling together and within the voids, recesses or pores of the metal structure.

20. The anode of claim 1, wherein the electrochemically active material is a dried and/or heat treated applied slurry or suspension containing colloidal material.

21. The anode of claim 20, wherein the electrochemically active material is obtainable from the group consisting of colloidal material containing at least one colloid selected from colloidal alumina, ceria, lithia, magnesia, silica, thoria, yttria, zirconia and colloids containing active constituents of the active material.

22. A cell for the electrowinning of aluminium equipped with at least one non-carbon metal-based anode according to claim 1.

23. The cell of claim 22, comprising at least one aluminium-wettable cathode.

24. The cell of claim 23, which is in a drained configuration.

25. The cell of claim 24, comprising at least one drained cathode on which aluminium is produced and from which aluminium continuously drains.

26. The cell of claim 22, which is in a bipolar configuration and wherein the anodes form the anodic side of at least one bipolar electrode and/or a terminal anode.

27. The cell of claim 22, comprising means to circulate the electrolyte between the anodes and facing cathodes and/or means to facilitate dissolution of alumina in the electrolyte.

28. A method of producing aluminium in a cell according to claim 22, wherein oxygen ions in the electrolyte are oxidised and released as molecular oxygen by the electrochemically active anode material.

29. The method of claim 28, wherein the electrolyte is at a temperature of 700° C. to 970° C.

30. A method of manufacturing a non-carbon, metal-based anode of a cell for the electrowinning of aluminium, said method comprising providing an electrically conductive, high temperature resistant and oxidation resistant metal structure in the form of a wire mesh or net, a foraminate sheet, a fibrous network, a reticulated skeletal structure, or a porous structure having voids recesses and/or pores;

applying an electrically conductive and electrochemically active material or a precursor thereof into the voids, recesses and/or pores so as to at least partly fill them, and heat-treating the active material or precursor contained in the voids, recesses and/or pores to consolidate and form an anode for the oxidation of oxygen ions present at the anode surface/electrolyte interface.

31. The method of claim 30, wherein at least some of the voids, recesses and/or pores are only partly filled by coating their surfaces with the electrochemically active material or a precursor thereof, leaving an unfilled cavity in said partly filled voids, recesses and/or pores.

32. The method of claim 30, wherein after heat treating the anode the electrochemically active material in said voids, recesses and/or pores is porous.

33. The method of claim 30, wherein the surface of the metal structure is inert and substantially resistant to the electrolyte and the product of electrolysis.

34. The method of claim 33, comprising forming an oxygen barrier layer on the metal structure.

35. The method of claim 34, wherein the oxygen barrier is formed on the metal structure by slurry-brushing or electrodeposition and heat treating.

36. The method of claim 34, wherein the oxygen barrier is formed on the metal structure by oxidising the surface of the metal structure.

37. The method of claim 34, wherein the oxygen barrier layer comprises chromium oxide and/or black non-stoichiometric nickel oxide.

38. The method of claim 34, comprising covering the oxygen barrier layer with a protective layer protecting the oxygen barrier by inhibiting its dissolution and which during electrolysis remains electrochemically inactive.

39. The method of claim 38, wherein the protective layer is applied by electrodeposition.

40. The method of claim 39, wherein the protective layer comprises copper, or copper and at least one of nickel and cobalt, and/or oxide(s) thereof.

41. The method of claim 30, wherein the metal structure comprises at least one metal selected from the group consisting of nickel, cobalt, chromium, copper, molybdenum and tantalum, and their alloys or intermetallic compounds, and combinations thereof.

42. The method of claim 41, wherein the metal structure is nickel-plated copper or a nickel-copper alloy.

43. The method of claim 30, wherein said voids, recesses and/or pores are filled with at least one constituent selected from the group consisting of oxides, oxyfluorides, phosphides, carbides, and combinations and/or a precursor thereof.

44. The method of claim 43, wherein said voids, recesses and/or pores are filled with cerium oxyfluoride or precursor thereof.

45. The method of claim 43, wherein said voids, recesses and/or pores are filled with spinels and/or perovskites, or a precursor thereof.

46. The method of claim 43, wherein said voids, recesses and/or pores are filled with at least one ferrite, or a precursor thereof.

47. The method of claim 46, wherein said voids, recesses and/or pores are filled with at least one ferrite selected from the group consisting of cobalt, manganese, nickel, molybdenum, magnesium and zinc ferrite, and mixtures thereof, or a precursor thereof.

48. The method of claim 47, wherein constituents of the electrochemically active material are bonded together and within the voids, recesses and/or pores of the metal structure with a bonding material substantially resistant to cryolite.

49. The method of claim 30, wherein said voids, recesses and/or pores are filled with electrochemically active constituents and an electrocatalyst or precursors thereof for the oxidation of oxygen ions present at the surface of the anode to form monoatomic nascent oxygen and subsequently biatomic molecular gaseous oxygen.

50. The method of claim 49, wherein the electrocatalyst is selected from the group consisting of iridium, palladium, platinum, rhodium, ruthenium, silicon, tin and zinc, the Lanthanide series and Mischmetal, and their oxides, mixtures and compounds thereof.

51. The method of claim 30, wherein the electrochemically active material comprises at least one metal selected from the group consisting of iron, chromium and nickel, and oxides, mixtures and compounds thereof.

52. The method of claim 30, wherein constituents of the precursor of the electrochemically active material are reacted together upon heat treatment to form the active material.

53. The method of claim 30, wherein at least one constituent of the precursor of the electrochemically active material is reacted by upon heat treatment with the metal structure to form the active material.

54. The method of claim 30, wherein the electrochemically active material is applied in the form of powder into the voids, recesses and/or pores of the metal structure.

55. The method of claim 30, wherein the electrochemically active material is applied in the form of a slurry or suspension containing colloidal material and then dried and/or heat treated.

56. The method of claim 55, wherein electrochemically active material is applied in the form of a slurry or a suspension comprising at least one colloid selected from the group consisting of colloidal alumina, ceria, lithia, magnesia, silica, thoria, yttria, zirconia and colloids containing active constituents of the active material.

57. The method of claim 30, wherein the electrochemically active material is applied by electrodeposition.

58. The method of claim 30 for reconditioning a used metal-based anode, said anode comprising an electrically conductive, high temperature resistant and oxidation resistant metal structure in the form of a wire mesh or net, a foraminate sheet, a fibrous network, a reticulated skeletal structure, or a porous structure having voids, recesses and/or pores which are at least partly filled with an electrically conductive and electrochemically active material applied thereinto to form an anode for the oxidation of oxygen ions present at the anode surface/electrolyte interface when at least part of the active material of said anode is worn or damaged, said method comprising clearing at least the worn or damaged parts of the material contained within the voids, recesses and/or pores of the metal structure before at least partly refilling said voids, recesses and/or pores with an active material or precursor thereof, and heat treatment to reform the anode for the oxidation of oxygen ions in the electrolyte.

* * * * *